US007196293B2

(12) United States Patent
Britto

(10) Patent No.: US 7,196,293 B2
(45) Date of Patent: Mar. 27, 2007

(54) TIMED ACCESSORY ADAPTER

(75) Inventor: James J. Britto, Westport, MA (US)

(73) Assignee: The First Years Inc., Avon, MA (US)

( * ) Notice: Subject to any disclaimer, the term of this patent is extended or adjusted under 35 U.S.C. 154(b) by 356 days.

(21) Appl. No.: 10/836,801

(22) Filed: Apr. 30, 2004

(65) Prior Publication Data

US 2005/0242770 A1 Nov. 3, 2005

(51) Int. Cl.
*H05B 1/02* (2006.01)
*H05B 3/54* (2006.01)
*H01R 4/00* (2006.01)

(52) U.S. Cl. ..... 219/441; 219/387; 219/435; 219/442; 219/528; 219/489; 219/492; 99/332; 439/374; 439/668

(58) Field of Classification Search ..... None
See application file for complete search history.

(56) References Cited

U.S. PATENT DOCUMENTS

| | | | | |
|---|---|---|---|---|
| 2,927,189 | A * | 3/1960 | Purpura | 219/441 |
| 3,243,576 | A * | 3/1966 | Lee et al. | 219/386 |
| 3,245,337 | A * | 4/1966 | White et al. | 99/331 |
| 3,969,610 | A * | 7/1976 | Ratti et al. | 219/441 |
| 5,274,736 | A * | 12/1993 | Rohr, Jr. | 392/447 |
| 5,408,068 | A | 4/1995 | Ng | |
| 5,436,429 | A | 7/1995 | Cline | |
| 5,463,203 | A | 10/1995 | Moore | |
| 5,968,396 | A | 10/1999 | Rodriguez | |
| 6,064,044 | A | 5/2000 | Jerome | |
| 6,571,564 | B2 | 6/2003 | Upadhye et al. | |
| 6,607,391 | B2 * | 8/2003 | Mendelson et al. | 439/39 |
| 6,870,135 | B2 * | 3/2005 | Hamm et al. | 219/386 |

FOREIGN PATENT DOCUMENTS

| | | |
|---|---|---|
| EP | 0824299 | 2/1998 |
| WO | WO 98/32692 | 7/1998 |

* cited by examiner

*Primary Examiner*—Joseph Pelham
(74) *Attorney, Agent, or Firm*—Michael Best & Friedrich LLP

(57) ABSTRACT

An electric adapter for providing output power to an accessory includes an adapter housing having a projection configured for insertion into a DC power accessory port, the projection carrying an electrical input conductor, a power outlet cord extending from the housing, a manually operable power switch mounted on the housing, the switch operable to electrically connect the electrical input conductor to the power outlet cord, and a timer circuit contained within the housing and configured to electrically disconnect the input conductor from the power outlet cord after a predetermined cycle time period, without removing the projection from the DC power accessory port.

25 Claims, 6 Drawing Sheets

TIMED ACCESSORY ADAPTER

TECHNICAL FIELD

This invention relates to an electrical adapter for powering accessories, and more particularly to adapters for use with the accessory port of an automobile.

BACKGROUND

Portable electrical devices can be designed for operation with the 12-volt electrical systems commonly present in automobiles. The accessory port of an automobile, originally used for cigarette lighters, can also provide electrical power for portable devices. Accessory adapters are designed for insertion into the accessory port for providing power to the portable devices.

SUMMARY

An electric adapter for providing output power to an accessory includes an adapter housing having a projection that carries an electrical input conductor and is configured for insertion into a DC power accessory port, a power outlet cord extending from the housing, a manually operable power switch mounted on the housing, and is operable to electrically connect the electrical input conductor to the power outlet cord, and a timer circuit contained within the housing and configured to electrically disconnect the input conductor from the power outlet cord after a predetermined cycle time period, without removing the projection from the DC power accessory port.

In some implementations, the cycle timer circuit can be configured to electrically connect the input conductor from the power outlet cord after a predetermined delay time period. The adapter can also include a timer switch connected to the timer circuit to set the predetermined cycle time period. The timer switch can include a first cycle control to set the cycle time period to a first cycle time period and a second cycle control to set the cycle time period to a second cycle time period. In some examples, the timer switch can also include a first delay control to set the delay time period to a first delay time period and a second delay control to set the delay time period to a second delay time period. The adapter can also include a sequence controller that requires the setting of the timer switch before the power switch is operable to electrically connect the electrical input conductor to the power outlet cord. The operable power switch can be adjustable to control the level of power output.

In other implementations, the adapter housing includes an integral fuse. The fuse can also be a user-replaceable. The adapter can also include a power indicator lamp configured to light when the adapter is inserted into the power accessory port.

In one example, the accessory is a heating unit electrically connected to the adapter by the power outlet cord. The heating unit can be configured for warming the contents of a baby bottle. The heating unit can include a flexible wrap having engagable fasteners at opposing ends and sized for covering a portion of the bottle. The heating unit can also include a temperature sensor, which can be a thermister, for example.

The heating unit can also include a temperature controller connected to the temperature sensor and configured to electrically disconnect the heating unit from the power outlet cord when the heating unit exceeds a maximum threshold temperature, and to electrically connect the heating unit from the power outlet cord when heating unit reaches a minimum threshold temperature.

The adapter can also include a temperature cut-off control connected to the temperature sensor the control configured to permanently electrically disconnect the heating unit from the power outlet cord when the heating unit exceeds a critical temperature.

In another aspect, an electric bottle warmer includes an adapter housing having a projection with an electrical input conductor for insertion into the a DC power accessory port, a power outlet cord extending from the housing, a manually operable power switch mounted on the housing, the switch operable to electrically connect the electrical input conductor to the power outlet cord, and a cycle timer circuit contained within the housing and configured to electrically disconnect the input conductor from the power outlet cord after a predetermined cycle time period, without removing the projection from the DC power accessory port. The bottle warmer also includes a flexible wrap having engagable fasteners at opposing ends and sized for covering a portion of the bottle, a resistance heating element disposed within the wrap and electrically connected to the power output cord of the adapter, a temperature sensor disposed within the wrap for measuring the temperature, and a thermal switch connected to the temperature sensor to control the electrical connection of the power output cord to the heating element.

In some implementations, the cycle timer circuit can be configured to electrically connect the input conductor from the power outlet cord after a predetermined delay time period. The bottle warmer can include a timer switch connected to the timer circuit to set the predetermined cycle time period. The timer switch can also include a first cycle control to set the cycle time period to a first cycle time period and a second cycle control to set the cycle time period to a second cycle time period. The timer switch can also include a first delay control to set the delay time period to a first delay time period and a second delay control to set the delay time period to a second delay time period.

In one implementation, the first cycle control is configured to heat the contents of a bottle having a first volume and the second cycle control is configured to heat the contents of a bottle having a second volume to predetermined temperature. The first and second controls can be located on the adapter housing and be marked with indicia corresponding to a first bottle volume and a second bottle volume, respectively. The bottle warmer can also include a sequence controller that requires the setting of the cycle timer switch before the electrical input conductor can be electrically connected to the power outlet cord.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
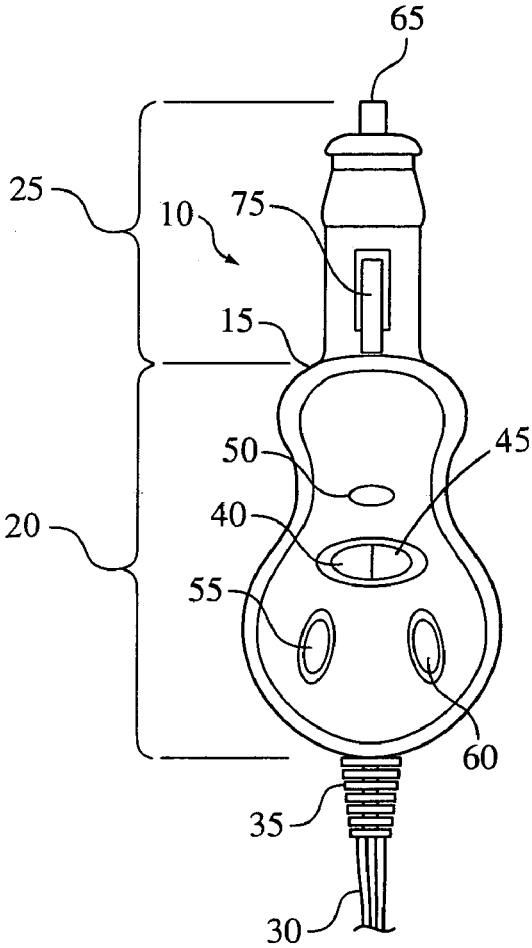
FIGS. 1A and 1B are plan and side views of an electrical adapter according to one example.
Figure 1B:
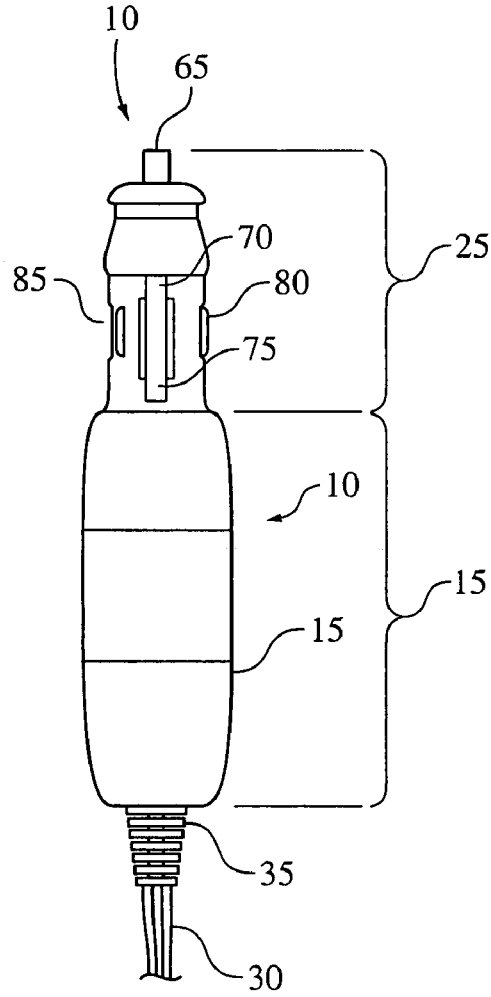

Referring to FIGS. 1A and 1B, an electrical adapter 10 is configured for engagement with a DC accessory power port, such as a typical 12-volt car receptacle, or a portable power source, such as a portable 12-volt power inverter, for example. The adapter 10 includes a housing 15 having a base region 20 and a port region 25. A power card 30 extends from a first end of the base region 20 at a molded strain relief 35. The base region 20 includes a power switch having an on-button 40 and an off-button 45. A power indicator light 50, a first timer control switch 55 and a second timer control switch 60 are disposed on a top surface of the housing 15. The buttons can be configured to illuminate when activated. The adapter 10 can be ergonomically designed for ease of insertion and removal from the accessory port, such as a typical 12-volt car receptacle, for example. The face of the housing 15 is substantially flush to permit ready access to buttons 40, 45, control switches 55, 60, and the indicator light 50. In one example, the length of the adapter 10 is about 30 millimeters and the width across the widest portion of the base region is about 50 millimeters.

The port region 25 is configured for engaging the accessory power port and includes a first electrical contact 65 disposed at an end of a tapered neck 70 and a second electrical contacts 75, 77 disposed along a length of both sides of the neck 70. Prongs 80, 85 extend along the length of both sides of the neck disposed between the second electrical contacts 75, 77 to secure the adapter 10 in the accessory port.

Figure 2:
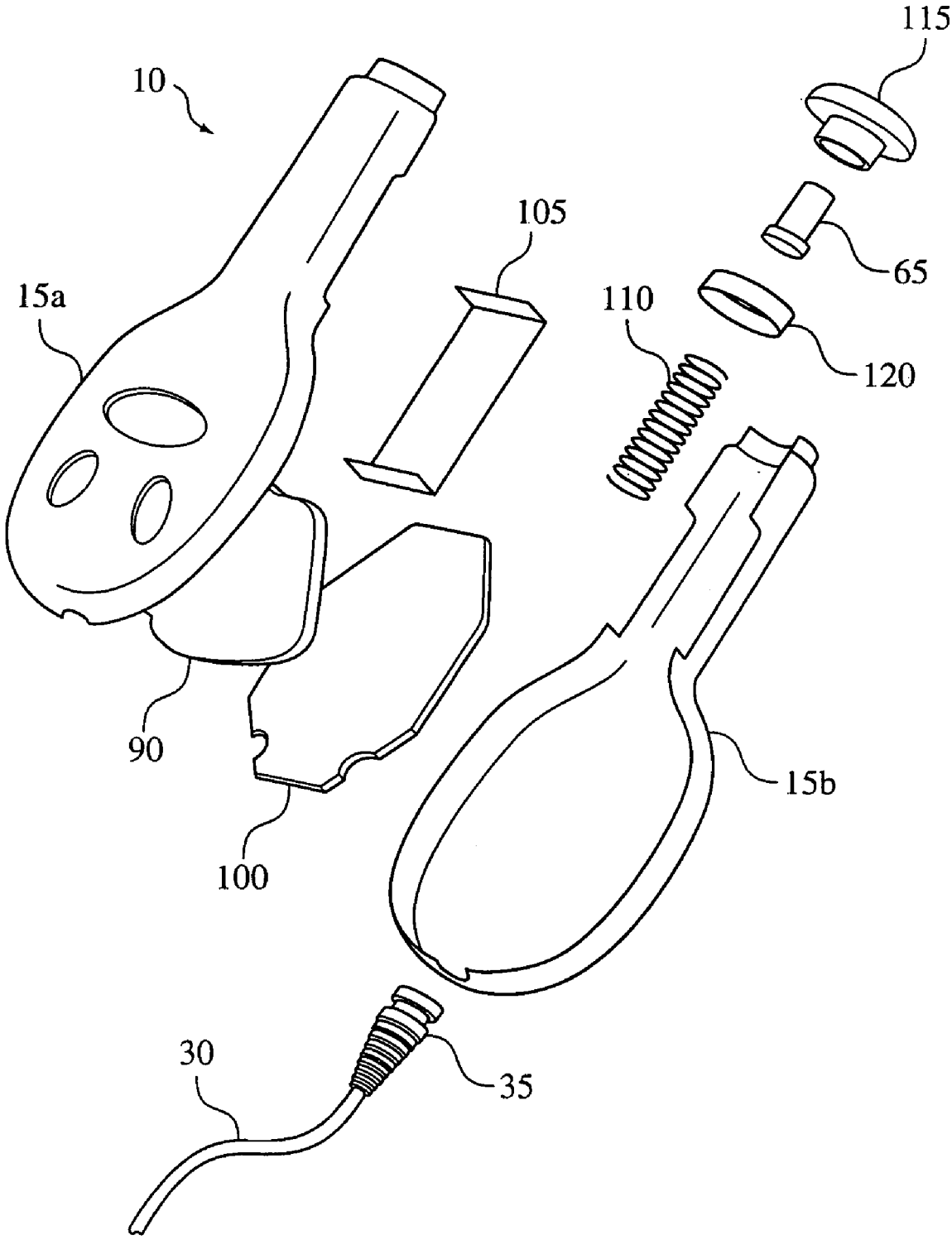
FIG. 2 is an exploded perspective view of the adapter of FIGS. 1A and 1B.

Referring now to FIG. 2, the exploded view of adapter 10 shows an upper housing 15*a* and a lower housing 15*b* containing internal components as follows. A control pad 90 includes the on-button 40, off-button 45, and timer controls 55, 60. A circuit 100 is connected to the control pad 90 and the power cord 30. A clip 105 is connected to the circuit 100 and includes protruding surfaces which extend through openings in the housing 15 to form the second electrical contacts 75, 77 (FIGS. 1A and 1B). A spring 110 biases the first electrical contact 65 outwardly against a cap 115 which secures a retainer ring 120 to the neck 70, by threaded engagement thereto, for example.

Figure 3:
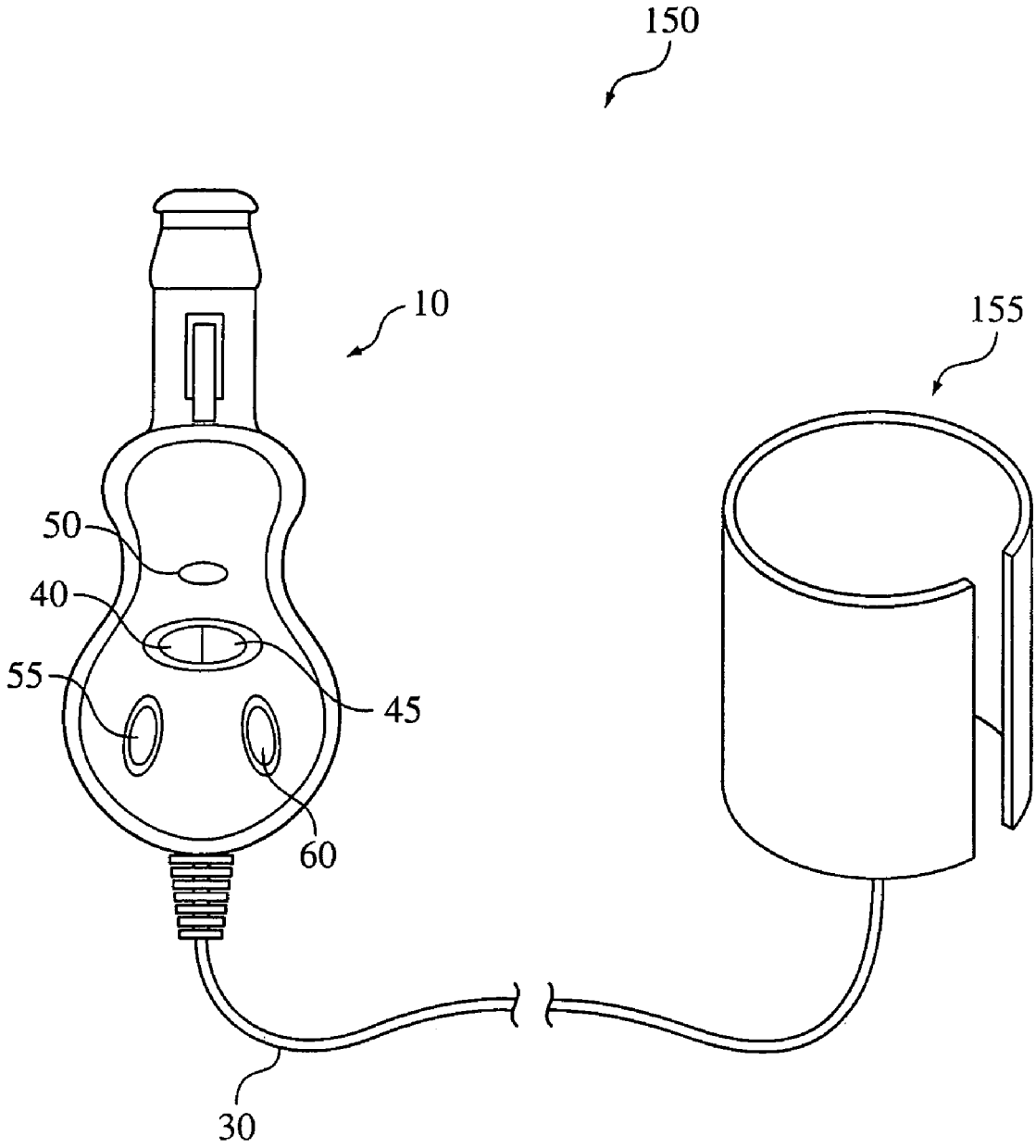
FIG. 3 is a schematic view of a system including an electrical adapter connected to a bottle warmer.

Referring now to FIG. 3, and in one example, a system 150 for heating a bottle containing a liquid includes the adapter 10 connected to a bottle warmer 155 by the power cord 30. The cord 30 is of sufficient length to permit convenient access to the bottle warmer 155 while the adapter 10 is inserted into the accessory port.

Figure 4:
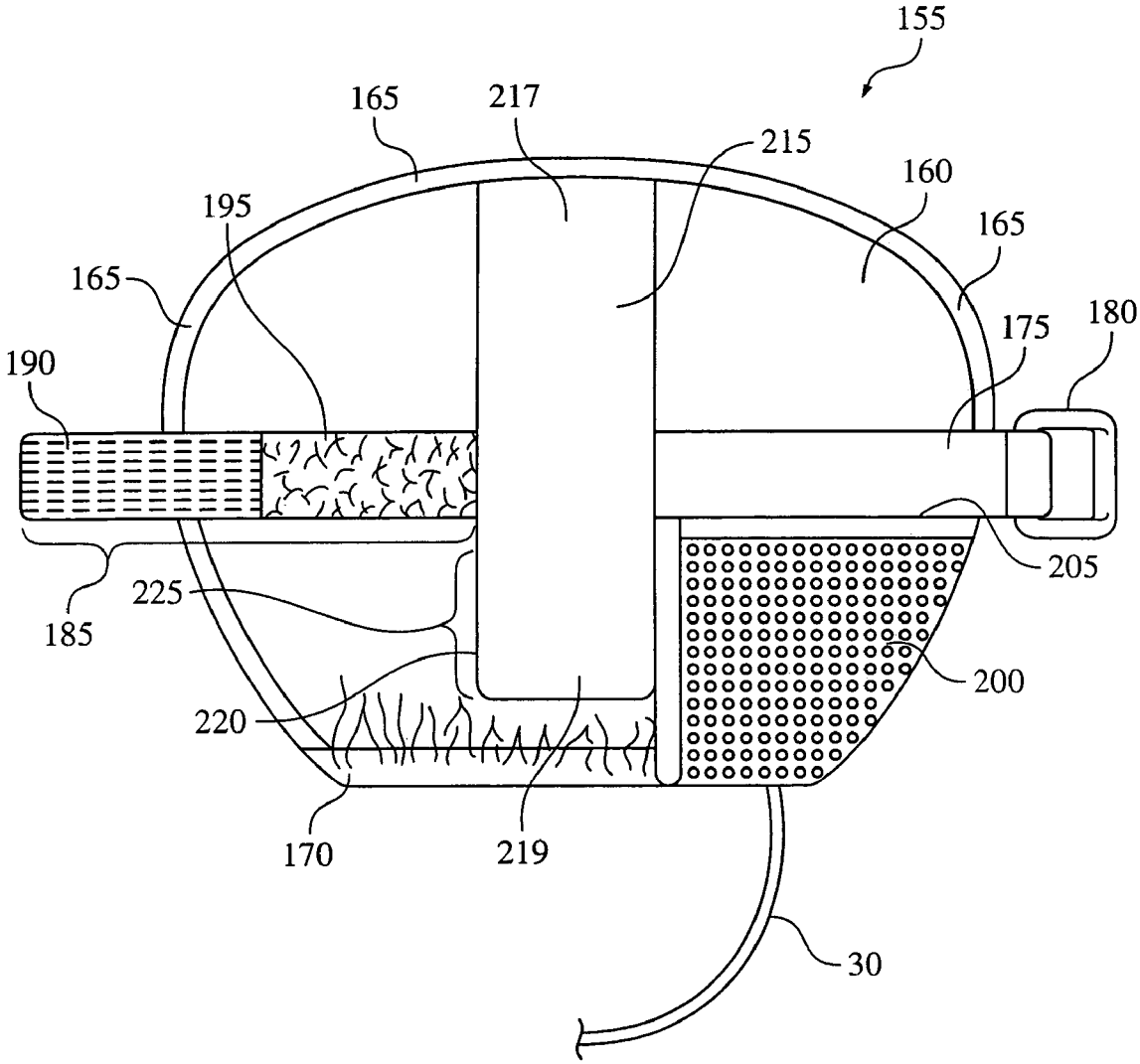
FIG. 4 is a plan view of a flexible wrap for a bottle warmer.
Figure 5:
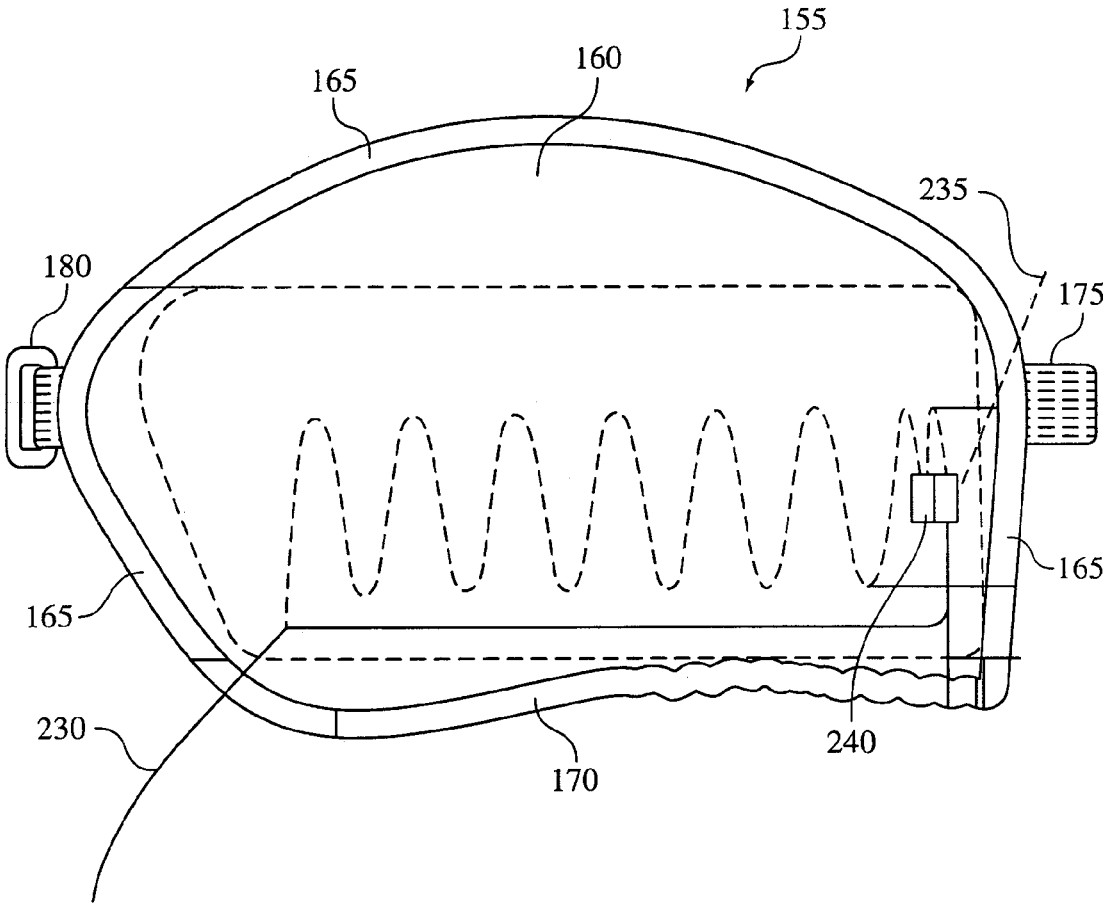
FIG. 5 is a diagrammatic view of the flexible wrap of FIG. 4, showing the internal electrical components.
Figure 6:
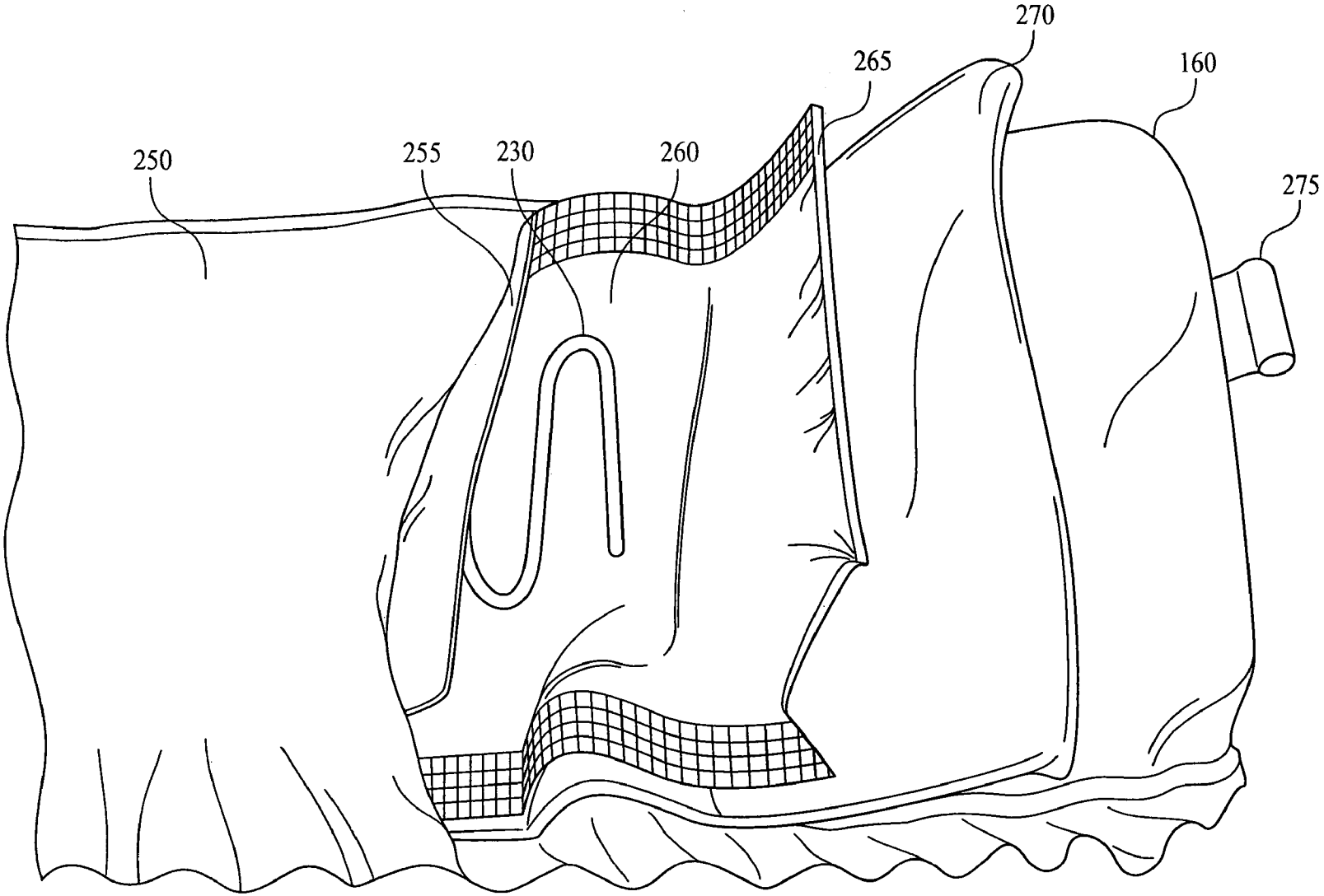
FIG. 6 is a detail view of the flexible wrap of FIG. 4, showing the multiple layers.

Referring now to FIGS. 4–6, the bottle warmer 155 is connected to power cord 30 and includes a flexible wrap 160 having a seem 165 along the top and side edges, and an elastic cord threaded along the bottom edge 170. The wrap 160 is sized and configured to be wrapped around a bottle (not shown), the drawn edge 170 contours the wrap 160 to securely fit a tapered portion of the bottle. A strap 175 is attached to a middle portion of the wrap 160 and includes a buckle 180 at a first end and a touch fastener 185 at a second end, the touch fastener having a first region 190, such as hooks for example, and a second region 195, such as loops for example.

After the wrap 160 is wrapped around the bottle, the second end of the strap 175 can be inserted into the buckle 180 and pulled back toward the strap to releasably engage the first region 190 with the second region 195 of the touch fastener, thereby securing the wrap 160 around the bottle. A mesh pocket 200 having an opening 205 can be disposed along a portion of the wrap 160 for storing the power cord 30. An elastic cord is threaded along the top edge 210 of the opening 205 to keep the edge 210 taught and adjacent the wrap 160 while permitting some defamation for opening the pocket 200. A flap 215 is disposed in a generally vertically orientation and attached to an upper edge of the wrap 160 at a first end 217 and releasably attached to a lower portion of the wrap 160 at a second end 219. The second end 219 includes a first region 220 of a touch fastener with a second region 225 of the touch fastener is affixed to a lower portion of the wrap 160. The flap 215 can inserted through a loop of an accessory bag (not shown) for attaching the wrap 160 thereto when the system 150 is not in use. The accessory bag can be insulated and adapted for holding icepacks and for storing the bottles until they are ready to be heated.

Referring to FIG. 5, the electrical components of the warmer 155 include a heating wire 230 disposed along an inside surface of the wrap 160. The heating wire 230 is electrically connected to a heat overload fuse 235 and a non-resettable thermal cut-off switch 240, both of which can include temperature sensors and are disposed along an inside surface of the wrap 160. The heating wire 230 is connected to a re-setting temperature controller, which can be included in the circuit 100, contained within the housing of the adapter, for example, having a rating of 95 C +/−5.0 C. In one example, when the re-setting temperature controller senses a temperature exceeding a predetermined critical temperature, electric current is disconnected from the heating wire 230. When the temperature falls to 65+/−15.0 C, electric current is reconnected to the heating wire. As a failsafe measure, the thermal cut-off switch 240, disconnects electric current from the heating wire 230 if the measured temperature reaches 113 C, in the event that the temperature controller fails.

Referring to FIG. 6, the wrap 160 includes multiple layers including an inner layer 250, a flexible metallic foil 255, the resistance heating wire 230, a foil-coated heat conductive/reflective layer 260, a foam-backed reflective/insulation bonded material 265, a polyurethane foam layer 270, and an outer layer 275. The combination of multiple layers provide the desired thermal and structural properties for the wrap 160.

The inner and outer layers 250, 275 are formed from a textured polyvinyl carbonate which are flame-retardant and heat resistant to about 120 C. Each layer has a thickness of about 0.3 mm. The flexible metallic foil 255 includes an adhesive backing that secures the heating wire 230 in place to the foil-coated heat conductive/reflective layer 260 in a coiled or looped configuration to maximize resistance heat dispersion. The heating wire 230 is rated for about 36 W+/−5%, and has a resistance value of about 3.65 ohm/meter. The wire is formed from Fe Cr and has a diameter of about 0.7 0 mm. The wire can be coated with a wire wrap of extruded silicon, having a heat resistance up to about 180 C and include two-rope glass fiber having a heat resistance up to about to 200 C. The foil coated heat conductive/reflective layer 260 is formed from four material bonded compositions including a first layer of metallic foil, a second layer of paper, a third layer of glass fiber and a fourth layer of metallic foil. Layer 260 is the primary heat conduction/reflective medium to direct heat generated from the heating wire 230 toward the radial center of wrap 160 when in a wrapped configuration about the bottle. The glass fibers add strength to the material and the paper adds thermal insulation. The foam-backed reflective/insulation bonded material 265 includes a top layer having a quilted metallic foil for providing an additional heat reflective medium for the heating wire 230, and a back layer of expanded polyethylene foam (EPE) for insulation, having a thickness of about 3 mm. The polyurethane foam layer 270 adds additional insulation to minimize heat transfer to outside of the wrap 160. The foam layer 270 is fire-retardant, meets CA116/117 requirements and has a thickness of about 4 mm.

In operation, in one example, a user begins the using the system by inserting the starts the system 150 by inserting the port region 25 of the adapter into the accessory port. Once the adapter is plugged into a 12V receptacle (typical automobile "accessory" receptacle), the indicator light 50 illuminates, such as a red LED light, for example, to signal that power is available to the adapter 10, yet, no heat is applied to the wrap 160.

The user then places a bottle in the wrap 160 and secures it tightly around the bottle by inserting the second end of the strap 175 into the buckle 180 and pulling it back toward the strap 175 to join the first and second regions 190, 195 of the touch fastener 185. The drawn edge 170 retains the wrap 160 against the tapered end of the bottle.

Next, the user first sets the heating cycle duration corresponding to the amount of liquid to be heated, such as standard baby bottle sizes, 5 and 8 ounces, for example, by pressing one of the timer controls 55, 60 on the adapter. Each of the controls 55, 60 will illuminate when pressed, and shut off if pressed a second time. After the heating cycle duration is set, the user presses the on-button 40, which illuminates to indicate that power is flowing to the wrap 160. The control circuit 100 sends power to the heating wire 230 for the set heating cycle duration. In one example, the operation sequence requires the user to press the one of the timer controls 55, 60 button first, before pressing the on-button 40 to prevent an accidental one button starting of the system 150 by a child, for example.

In one example, if a user accidentally starts the system 150 without a bottle placed inside the wrap 160, the resetting temperature controller will control the dissipation of excess heat by automatically cycling the heating wire 230 off and on to minimize excess temperatures in the wrap 160 until the adapter off-button 45 is pressed, or the adapter 10 is removed from the accessory port. The resetting temperature controller will also cycle the heating wire 230 off and on while heating a bottle if localized regions of high temperature are detected. This can prevent accidental overheating localized area of the wrap 160 when all normal heat activation controls are properly finctioning. If the re-setting temperature controller fails, the fuse 235 will sense excessive temperature, and disconnect power from the heating wire 230, permanently. Alternatively, the heat overload fuse 235 can be user-replaceable. The control circuit 100 will also disconnect power from the heating wire 230 if an amperage input overload or an amperage draw overload, from an adapter circuitry fault, for example, is detected.

The control circuit 100 will continue to send power from the adapter 10 to the wire 230 to heat the wrap 160 for the duration of the heating cycle and then automatically disconnect power to the wire 230 and switch all button lights off, at the completion of the heating cycle. In one example, control circuit 100 will send power from the adapter 10 to the wire 230 for the time required to raise the temperature of liquid inside the bottle from 10 C (50 F) to 37 C (98 F). If the first timer control 55, corresponding to about 5 ounces, is pressed, the control circuit 100 will heat the warmer for about 15 minutes. If the second timer control 60, corresponding to about 8 ounces, is pressed, the control circuit will heat the warmer for about 22 minutes. During this time, the wire 230 heats the liquid inside the bottle to a suitable consumption temperature, for example, about 37 C. At any time, the user may stop the heating cycle before auto-shut off by pressing the off-button 45. This manual shut-off allows the user to interrupt the heating cycle, if for example, a 5 ounce bottle is placed in the wrap 160 and the second timer control 60 is set (for bottle having a volume of 8 ounces). This also allows a measure of control if the user does not wish to heat the liquid inside the bottle to the consumption temperature, or if the user is heating a bottle containing an already warm liquid. In one example, the power switch is adjustable to control the power level to the wire 230 and the heat generated in the wrap 160.

A number of embodiments of the invention have been described. Nevertheless, it will be understood that various modifications may be made without departing from the spirit and scope of the invention. For example, in place of the bottle warmer 155, an electric warming blanket, a baby wipes warmer, a cell phone charger, a seat warmer, or an auxiliary light could be connected to the adapter 10. Accordingly, other embodiments are within the scope of the following claims.

What is claimed is:

1. An electric adapter for providing output power to an accessory, the adapter comprising:

an adapter housing having a projection configured for insertion into a DC power accessory port, the projection carrying an electrical input conductor;

a power outlet cord extending from the housing;

a manually operable power switch mounted on the housing, the switch operable to electrically connect the electrical input conductor to the power outlet cord; and a timer circuit contained within the housing and configured to electrically disconnect the input conductor from the power outlet cord after a predetermined cycle time period, without removing the projection from the DC power accessory port.

2. The electric adapter of claim 1 wherein the cycle timer circuit is configured to electrically connect the input conductor from the power outlet cord after a predetermined delay time period.

3. The adapter of claim 1 further comprising a timer switch connected to the timer circuit to set the predetermined cycle time period.

4. The adapter of claim 3 wherein the timer switch further comprises a first cycle control to set the cycle time period to a first cycle time period and a second cycle control to set the cycle time period to a second cycle time period.

5. The adapter of claim 2 wherein the timer switch further comprises a first delay control to set the delay time period to a first delay time period and a second delay control to set the delay time period to a second delay time period.

6. The adapter of claim 3, further comprising a sequence controller, the controller requiring the setting of the timer switch before the power switch is operable to electrically connect the electrical input conductor to the power outlet cord.

7. The adapter of claim 1, wherein the operable power switch is adjustable to control the level of power output.

8. The adapter of claim 1 wherein the housing further comprises an integral fuse.

9. The adapter of claim 1 wherein the housing further comprises a user-replaceable fuse.

10. The adapter of claim 1, further comprising an indicator lamp, the lamp configured to illuminate when the adapter is inserted into the power accessory port.

11. The adapter of claim 1 wherein the accessory comprises a heating unit electrically connected to the power outlet cord.

12. The adapter of claim 11 wherein the heating unit is configured for warming the contents of a baby bottle.

13. The adapter of claim 12 wherein the heating unit comprises a flexible wrap having engagable fasteners at opposing ends and sized for covering a portion of the bottle.

14. The adapter of claim 12 wherein the heating unit further comprises a temperature sensor.

15. The adapter of claim 14 wherein the temperature sensor comprises a thermister.

16. The adapter of claim 14 wherein the heating unit further comprises a temperature controller connected to the temperature sensor, the temperature controlling configured to electrically disconnect the heating unit from the power outlet cord when the heating unit exceeds a maximum threshold temperature, and to electrically connect the heating unit from the power outlet cord when heating unit reaches a minimum threshold temperature.

17. The adapter of claim 14, further comprising a temperature cut-off control connected to the temperature sensor the control configured to permanently electrically disconnect the heating unit from the power outlet cord when the heating unit exceeds a critical temperature.

18. An electric bottle warmer comprising:

an electric power adapter for use with a DC power accessory port, the adapter comprising:

an adapter housing having a projection for insertion into the a DC power accessory port, the projection carrying an electrical input conductor;

a power outlet cord extending from the housing;

a manually operable power switch mounted on the housing, the switch operable to electrically connect the electrical input conductor to the power outlet cord; and a cycle timer circuit contained within the housing and configured to electrically disconnect the input conductor from the power outlet cord after a predetermined cycle time period, without removing the projection from the DC power accessory port, a flexible wrap having engagable fasteners at opposing ends and sized for covering a portion of the bottle;

a resistance heating element disposed within the wrap and electrically connected to the power output cord of the adapter;

a temperature sensor disposed within the wrap for measuring the temperature thereof; and a thermal switch connected to the temperature sensor to control the electrical connection of the power output cord to the heating element.

19. The bottle warmer of claim 1 wherein the cycle timer circuit is configured to electrically connect the input conductor from the power outlet cord after a predetermined delay time period.

20. The bottle warmer of claim 19 further comprising a timer switch connected to the timer circuit to set the predetermined cycle time period.

21. The bottle warmer of claim 20 wherein the timer switch further comprises a first cycle control to set the cycle time period to a first cycle time period and a second cycle control to set the cycle time period to a second cycle time period.

22. The bottle warmer of claim 20 wherein the timer switch further comprises a first delay control to set the delay time period to a first delay time period and a second delay control to set the delay time period to a second delay time period.

23. The bottle warmer of claim 21 wherein the first cycle control is configured to heat the contents of a bottle having a first volume and the second cycle control is configured to heat a bottle having a second volume to predetermined temperature.

24. The bottle warmer of claim 23 wherein the first and second controls are located on the adapter housing and comprise indicia corresponding to a first bottle volume and a second bottle volume, respectively.

25. The bottle warmer of claim 17, further comprising a sequence controller, the controller requiring the setting of the cycle timer switch before the electrical input conductor can be electrically connected to the power outlet cord.

* * * * *